US005158396A

United States Patent [19]

Menard

[11] Patent Number: 5,158,396

[45] Date of Patent: Oct. 27, 1992

[54] ADJUSTABLE LEVEE GATE

[76] Inventor: Bill Menard, Rte. 1, Box 1A, Gillett, Ark. 72055

[21] Appl. No.: 833,052

[22] Filed: Feb. 10, 1992

[51] Int. Cl.[5] ..... E02B 7/20

[52] U.S. Cl. ..... 405/91; 405/101; 405/115

[58] Field of Search ..... 405/87, 90, 91, 101, 405/107, 108, 115

[56] References Cited

U.S. PATENT DOCUMENTS

| | | | |
|---|---|---|---|
| 1,080,944 | 12/1913 | Baker | 405/91 |
| 2,485,755 | 10/1949 | Loosli | 405/90 |
| 2,694,292 | 11/1954 | Wing | 405/90 |
| 2,698,518 | 1/1955 | Hofferber | 405/91 |
| 3,091,934 | 6/1963 | Jacobs | 405/91 |

*Primary Examiner*—David H. Corbin
*Attorney, Agent, or Firm*—Robert R. Keegan

[57] ABSTRACT

There is disclosed a liquid confinement structure to control the depth of water contained by earthen levees in a rice field or the like and to allow excess water to flow through a gate therein to prevent overflow and washout of the levees. The structure includes a horizontally elongated panel of rigid sheet aluminum for placement in a gap in an earthen water containment levee. The panel has a central cutaway portion closed by a rigid gate about eight inches high by about four feet wide articulated by a flexible strip joining the bottom of the gate to the horizontal edge of the cutaway portion. When the gate is tilted downward to permit water flow to lower the level of the water, the water is prevented from flowing around the ends of the gate by flaps forming seals between the edges of the gate and the edges of the opening in the panel. The gate element is held at a desired angle for controlling water level by a restraining chain at each end of the gate, the links of which may be captured in a slot in the top of the panel adjacent the cutaway portion. Openings at the extremities of the panel provide hand holds or means for engagement of hooks to facilitate installing, handling, or removing the structures.

10 Claims, 1 Drawing Sheet

ADJUSTABLE LEVEE GATE

The present invention relates to gate devices to control the depth of a body of water contained by levees in a rice field, or the like. The devices allow excess water to flow out of the containment area without eroding the levees while maintaining a desired water depth which can readily be adjusted.

It is particularly important in the agricultural production of rice for the grower to maintain a shallow depth of water across the fields, which are not often of uniform elevation relative to one another. Farmers in the United States construct earthen levees at contour intervals designed to control the depth in the flooded rice fields. To illustrate the point, assume that a rice field of forty acres had a fall of two feet from the top of the field to the bottom. A levee that would contain two feet of water at the bottom would hold water over the entire surface of the field and a flood would be achieved, but the rice crop will grow only in shallow water so this type of flooding is unsuitable.

The accepted practice is to make smaller containment increments by installing more but smaller earthen levees. These levees may contain three to four inches of water at the lowest elevation and this will cover the upper portion to a depth of approximately one inch. This has proven to be ideal depths for rice growth and it therefore requires about eight levels and gates to maintain the correct depth of flood across the field with a two foot fall.

At least one of the gates is installed in each levee at a low elevation to facilitate the flow of water through the field and to maintain the water level in each containment area. The design of the gates must also be able to maintain the flood and transfer excess water from a rain through and to the outside of the field quickly enough to avoid overflowing and breaking the levees. The adjustment of the gates must be changed throughout the season, sometimes at each flooding of the field, so ease of adjustment is critical.

Some approaches to constructing levee gates for flooded agricultural fields have been very crude and others somewhat more sophisticated, but none provided very satisfactory solutions to the problems involved. One commonly used arrangement consisted of providing a section of the levee of lower height and using tarpaper roofing to cover the earth and produce a spillway to prevent overflow and erosion of the levee. Since such an arrangement had to be totally reconstructed whenever one desired to change the water level it was very unsatisfactory.

Another levee gate arrangement has involved the use of elongated steel plates to be set into or driven into the ground with the top of the gate at least somewhat below the minimum earth and levee height. Although theoretically adjustable by raising or lowering the steel plate, special tools are required to drive down or to withdraw the plate. Plastic gates have also been employed, and while they are inexpensive and may include an adjustment feature, they are easily torn or damaged and have an average useful life of a year at best. The adjustment on the plastic gates is prone to slippage which can inadvertently drain the containment area, and they are not secure in adverse weather conditions of wind or heavy rain.

Water containment barriers for other purposes have some features in common with the levee gates used in agriculture, but they do not provide the combination of functions of the present invention. For example, U.S. Pat. No. 4,377,352 to Goodstein granted Mar. 22, 1983, U.S. Cl. 405/115 shows a structure with hinged arms locatable at spaced intervals and adapted to support and secure a flexible plastic barrier. The Goodstein device is provided with a float element so that the hinged arms pivot to keep the barrier above the water level as the water level changes. There is no provision for permitting and controlling overflow of water over the barrier. U.S. Pat. No. 3,173,269 to Imbertson issued Mar. 16, 1965, U.S. Cl. 61-30 shows a collapsible dam for a water way or spillway in which adjustability is achieved with an inflatable plastic bag or envelope. It also includes a provision for sealing the space between the ends of the inflated envelope and a channel or spillway. This is clearly a different approach to a general problem not suitable for the agricultural field environment wherein the present invention is most useful. U.S. Pat. No. 2,118,535 to Betts issued May 24, 1938, shows a rigid gate structure hinged at the bottom serving as a water flow gate for use in the spillway of a dam. The Betts device is not arranged to be adjustable, it is arranged particularly to fit in a rectilinear opening in order that a reasonably good seal at the ends of the gate against the opening can be achieved. U.S. Pat. No. 4,455,106 to Johnson, issued Jun. 19, 1984, U.S. Cl. 405/94; U.S. Pat. No. 2,966,777 to Filho, issued Jan. 3, 1961, U.S. Cl. 61-26; and U.S. Pat. No. 1,438,913 to Grillich, issued Dec. 12, 1922, show water gates with a hinge-like structure permitting them to be opened or closed, but beyond this do not provide features which would be useful in the field of agricultural levee gates.

The present invention provides a vertically elongated member, formed of rigid sheet aluminum preferably, suitable for vertical placement in the depression or gap in an earthen water containment levee; the sheet has a central cut away portion closed by a rigid gate, also preferably of sheet aluminum and hinged at the bottom. Water is prevented from flowing around the ends of the gate by a flap forming a seal between the edge of the gate and the edge of the opening, the flap being wide enough to allow the gate to assume a substantially horizontal position when fully opened. The rotatable gate element is held at a desired angle by a restraining chain at each end, or by other suitable means. This structure is very rugged and durable, is easy to install, and provides very rapid adjustment to achieve or maintain the desired water level. These advantages are not available from known prior devices for agricultural purposes or other analogous water control devices.

In addition to providing the features and advantages described above, it is an object of the present invention to provide an adjustable levee gate for control of water flow in rice fields or other agricultural fields wherein the main panel of the structure is of thin rigid sheet material readily inserted in a gap prepared in an earthen levee and in which the panel is provided with a central hinged portion which can be manipulated to control the level at which water will overflow; the spillway provided is several feet in width to allow a large volume rate of water flow, thereby preventing the water level from rising over the levee height and eroding the levees during heavy rains.

It is another object of the present invention to provide water control in gate devices for agricultural fields wherein a vertically elongated gate element is hinged to the main panel of the device along a vertical axis at the bottom of the gate element and the gap at the respective ends of the gate element between it and the main panel are closed by flaps of flexible sheet material, thus preventing leakage or water flow which would allow the water level to drop below the top edge of the gate element.

It is still another object of the present invention to provide such apparatus having simple mechanical means such as a length of steel chain attached to the gate element and which can be engaged in slots in the main panel at one of a plurality of selected positions to set the position of the gate element, and thus the overflow height for the contained water.

Other objects and advantages of the present invention will be apparent from consideration of the following description in conjunction with the appended drawings in which.

Figure 1:
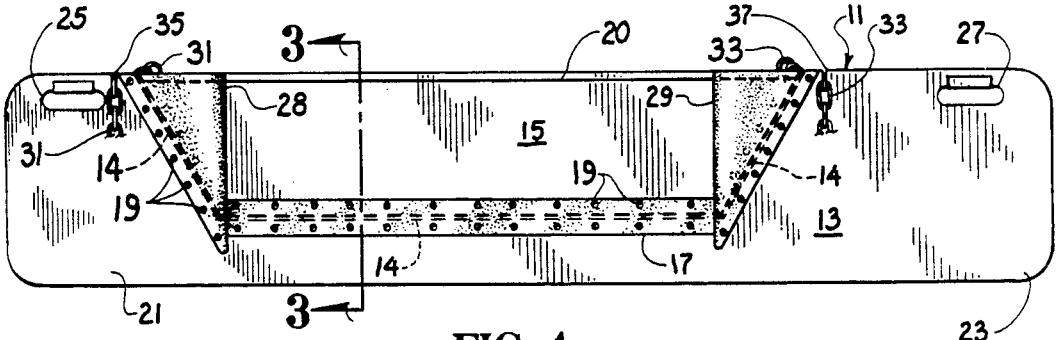
FIG. 1 is a front elevational view of one form of adjustable levee gate structure (in closed position) according to the invention.
Figure 2:
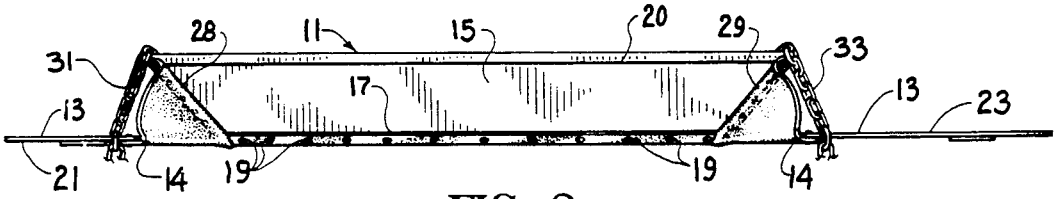
FIG. 2 is a top plan view of the apparatus of FIG. 1.
Figure 3:
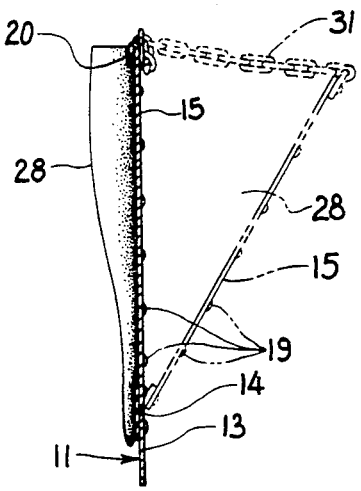
FIG. 3 is a vertical sectional enlarged view of the apparatus of FIG. 1 taken along the line 3—3 in FIG. 1.

Referring now to the drawings, and particularly FIGS. 1, 2, and 3, a liquid containment structure 11 as shown, including a horizontally elongated panel 13 formed of ⅛ inch aluminum plate and a rigid elongated gate element 15, also formed of aluminum plate and hingedly attached at its bottom edge by a strip 17 of elastomeric material to the bottom edge of an opening 14 in panel 13. Panel 13 is preferably about six feet long by one foot high.

The ends of gate element 15 are secured to a flap of flexible material 29 which may be of elastomeric material, other plastic or woven or nonwoven fabric. An opposite edge of flap 29 is secured to the generally vertical side of opening 14 in panel 13 and the shape and quadrilateral configuration of flap 29 is such as to form a triangular pocket as illustrated in FIG. 3 when gate element 15 is in the vertical closed position. The configuration of flap 28 is similar to that of flap 29. Flaps 28 and 29 and strip 17 may be secured to panel 13 and gate element 15 by a plurality of rivets 19, by adhesive, or by other fastening means or combinations thereof. The top of gate element 15 may be bent over as shown at 20 to impart greater rigidity to gate element 15.

Flaps 28 and 29 are sufficiently wide so that they will permit gate element 15 to rotate to a nearly horizontal position before limiting its further movement. When gate element 15 is completely lowered, the water behind levee gate 11 will be allowed to flow out of the confined area until its level is approximately that of the bottom of cut-out portion 14 and panel 13. In FIGS. 1-3, sections 21 and 23 of panel 13 are of different length although they could, of course, be made of equal length to provide a symmetrical structure.

Openings 25 and 27 in panel 13 provide means for engaging the panel for removal or placement, either by hand or by the use of hydraulic powered lift apparatus usually available on farm vehicles. Holes 25 and 27 will normally be covered with the soil of the levee in which the levee gate is embedded and thus will not be a passageway for undesired water flow. However, openings 25 and 27 may be covered with a flap of material similar to flaps 28 and 29 on the flooded side of panel 13. Such flaps would automatically prevent water flow through openings 25 and 27 if they were not covered with soil, while allowing insertion of a hand or a hook into the opening for removing the panel or otherwise facilitating handling thereof.

The extent to which gate element 15 is tilted or rotated to open the gate and reduce the level of the confined water may be controlled by any suitable adjustment mechanism which is exemplified in FIGS. 1-3 by the link chain arrangement including chains 33 and 31 each secured at the top of gate element 15 near the end thereof. Chains 33 and 31 cooperate with slots 35 and 37 in which they may be engaged at any desired link position. Thus, rotating the gate element 15 to the desired angle places the top of gate element 15 at the desired water level and thereafter engaging chains 31 and 33 in slots 35 and 37 prevents gate element 15 from rotating to a lower position. Of course the force of the retained water and the weight of gate element 15 itself will maintain it in the lowered position. Chains 31 and 33 may be of galvanized steel, stainless steel, or aluminum; alternatively the chains 31 and 33 may be replaced by plastic strips or belts with a toothed configuration for selective positioning of gate element 15 by engagement of the toothed belt in slots 35 and 37.

It will be noted from FIGS. 1-3 that flaps 28 and 29 are secured on the outsides of panel 13 and gate element 15, which is the side to which gate element 15 is pivoted or rotated to open the gate. In some cases it may be desired to secure flaps 28 and 29 to the inside face of plate 13 or gate element 15 or both. Also, strip 17 may be placed on the opposite face of plate 13 and gate element 15 from that shown in FIGS. 1-3. Strip 17 may be supplemented or replaced by a different conventional form of hinge device.

Although panel 13 and gate element 15 are shown as formed of essentially flat, solid material, either or both could be formed with ridges or corrugations, or with a laminated construction to increase the rigidity while reducing the mass. Openings 25 and 27 for grasping or handling the structure 11 could be eliminated or could be replaced by one or more rings in the top of panel 13 to facilitate engagement with a hook or other tool.

Figure 4:
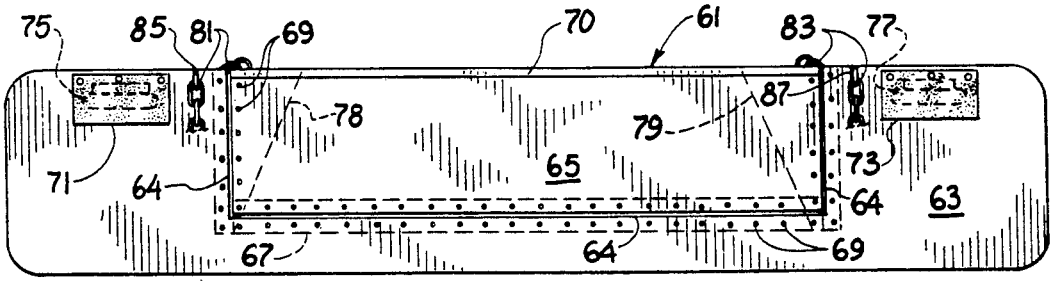
FIG. 4 is a front elevational view of an alternative form of the invention having a symmetrical main panel configuration and a rectangular (rather than trapezoidal) shape for the gate element.

Referring now to FIG. 4, an alternative form of structure 61 is shown, which eliminates some of the features of the preferred embodiment previously described, but has the advantage of simple inexpensive construction while effectively permitting control of irrigation water in a manner similar to that described with reference to FIGS. 1-3. Panel 63 has a rectangular cutout 64 and gate element 65 is also of rectangular shape. Accordingly, flaps 28 and 29 are arranged vertically and are substantially at right angles to strip 67 serving as a hinge for gate element 65, hinge 67 and flaps 78 and 79 are secured by rivets 69 or other suitable fasteners as previously described. Panel 63 is symmetrical and has symmetrically placed openings 75 and 77 serving as hand holds or for engagement of a hook or other tool. Holes 75 and 77 are covered by flaps 71 and 73 of elastomeric material secured just above openings 75 and 77 to the inside surface of panel 63. Flap 71 and 73 act as a seal to prevent water flow through opening 75 and 77 but allow entry of a hook or a hand from the outside of panel 13 to facilitate handling of structure 61.

From the foregoing description and explanation it will be appreciated that the present invention provides a liquid containment structure for controlling irrigation water in a rice field or other agricultural field enclosed by earthen levees which is simple in construction and easy to install and remove, but which provides all the necessary flow control and level control functions desired to maintain proper depths of water in the fields and to prevent overflow and washout of the earthen levees.

In addition to the variations and modifications to the invention that have been shown, described, or suggested, other variations and modifications will be apparent to those skilled in the art, and accordingly the scope of the invention is not to be considered as limited to those embodiments and variations shown, described, or suggested, but is rather to be determined by reference to the appended claims.

What is claimed is:

1. A liquid confinement structure comprising:

a first rigid member of substantially rectangular elongated shape;

a second rigid member of substantially rectangular elongated outline, with an upwardly opening indentation therein to provide an opening for the flow of a contained body of liquid;

means for hingedly attaching said first member to said second member to at least partially close said opening, whereby said opening is adjustable to cause flow to be controllable by the height of said first member; and flaps joining the vertical sides of said first member to adjacent edges of said second member formed of flexible sheet material, attached in a manner to prevent the egress of liquids between said first and second rigid members.

2. A liquid confinement structure as recited in claim 1 further including integrally formed hand hold openings in said second rigid member to facilitate handling, installation and removal.

3. A liquid confinement structure as recited in claim 1 further including means for adjustably setting the opening of said first rigid member relative to said second rigid member, said means being horizontally spaced from said opening.

4. A liquid confinement structure as recited in claim 1 in which installation of the structure in an earthen levee can be accomplished by means of downward pressure on the horizontal edges of the ends of said second rigid member.

5. Water level control apparatus for insertion in openings in earthen levees comprising:

a horizontally elongated panel of rigid material having a central portion of reduced height forming a liquid flow path and blade-like end portions for facilitating insertion thereof in said levees;

a horizontally elongated gate element having a top edge and a bottom edge and hingedly connected at the bottom edge to the central portion of said panel and adapted when in a vertical position to substantially close said flow path; and a flap of flexible material connected between each end of said gate element and an adjacent portion of said panel in a manner to substantially prevent liquid flow through said flow path other than over the top horizontal edge of said gate element.

6. A water level control apparatus as recited in claim 5 wherein said panel has an oval opening located at a vertical level near the top of said panel to facilitate handling of said structure.

7. Apparatus as recited in claim 5 further including means for adjustably positioning the top edge of said gate element, said means being horizontally spaced from said flow path.

8. A water level control apparatus as recited in claim 5 wherein said gate element has chains fixedly attached near said top edge at opposite ends thereof and horizontally spaced from said flow path.

9. A water level control apparatus as recited in claim 8 wherein said panel has two horizontally elongated vertical slots of width less than one-half inch located in said panel's top edge spaced from said flow path each said slot being adapted to engage a selected link of one of said chains thereby permitting manual adjustment of the angular position of said gate element and the height of its top edge.

10. A water level control structure for use in an earthen levee system of a water flooded agricultural field, comprising:

a panel member formed of rigid metal sheet and which is horizontally elongated and of a substantially rectangular outline, said member having a top edge and a bottom edge with a centrally located upwardly opening indentation in said rectangular outline in the top edge of said member thereby providing a flow path for the controlled flow of said water through said indentation, said bottom edge of said panel member having a thickness less than one-half inch providing a blade-like edge to facilitate the insertion of said structure into said earthen levee;

a horizontally elongated gate element of rigid metal and of substantially rectangular shape with dimensions not substantially less than said indentation in said first member, said gate element having a horizontal top edge and a bottom edge;

hinge means having a horizontal pivot axis attaching said gate element bottom edge to said panel member and capable of substantially closing said flow path when rotated about the pivot axis of said hinge means into a vertical position;

said gate member also being connected along each adjacent vertical side to said panel member by flaps of flexible material in such a manner as to substantially prevent water flow through such flow path other than over the horizontal top edge of said second member, said flaps being permanently connected in substantially sealing engagement to said first and second members by rivets;

said panel member having an opening located at a vertical level above the bottom of said flow path near an end of said panel member to facilitate handling of said structure;

said gate element having two chains fixedly attached near said horizontal top edge at opposite ends thereof;

said panel member also having two vertically elongated slots of width less than one-half inch in its top edge located near said indentation, each said slot being adapted to engage a selected link of one of said chains thereby permitting manual adjustment of the position of said gate element and the height of its top edge.

* * * * *